United States Patent [19]

Marshall et al.

[11] Patent Number: 4,638,639

[45] Date of Patent: Jan. 27, 1987

[54] GAS REFRIGERATION METHOD AND APPARATUS

[75] Inventors: John Marshall, Ascot; John D. Oakey, London, both of England

[73] Assignee: The BOC Group, plc, Windlesham, England

[21] Appl. No.: 758,001

[22] Filed: Jul. 23, 1985

[30] Foreign Application Priority Data

Jul. 24, 1984 [GB] United Kingdom ..... 8418840

[51] Int. Cl.[4] ..... F25J 1/00

[52] U.S. Cl. ..... 62/9; 62/38; 62/514 R

[58] Field of Search ..... 62/9, 36, 38, 39, 514 R

[56] References Cited

U.S. PATENT DOCUMENTS

| | | | |
|---|---|---|---|
| 3,677,019 | 7/1972 | Olszewski | 62/9 |
| 3,855,810 | 12/1974 | Simon et al. | 62/9 |
| 3,929,438 | 12/1975 | Harper et al. | 62/9 |
| 3,970,441 | 7/1976 | Etzbach et al. | 62/9 |
| 4,141,707 | 2/1979 | Springmann | 62/9 |
| 4,267,701 | 5/1981 | Toscano | 62/9 |

FOREIGN PATENT DOCUMENTS 1208196 10/1970 United Kingdom .

*Primary Examiner*—Ronald C. Capossela

*Attorney, Agent, or Firm*—Larry R. Cassett; Chris P. Konkol

[57] ABSTRACT

A method of liquefying a permanent gas stream, includes the steps of reducing the temperature of the permanent gas stream at elevated pressure to below its critical pressure and performing at least two working fluid cycles to provide at least part of the refrigeration necessary to reduce the temperature of the permanent gas to below its critical temperature. Each working fluid cycle comprises work-expanding the cooled working fluid in countercurrent heat exchange with the permanent gas stream and with the working fluid being cooled, refrigeration thereby being provided for the permanent gas stream. In at least one working fluid cycle, work-expanded working fluid is brought into countercurrent heat exchange relationship with the permanent gas stream at a temperature below the critical temperature of the permanent gas and in the or each such cycle on completion of the work expansion the working fluid is at a pressure of at least 10 atmospheres.

22 Claims, 5 Drawing Figures

GAS REFRIGERATION METHOD AND APPARATUS

BACKGROUND OF THE INVENTION

This invention relates to a refrigeration method and apparatus and is particularly concerned with the liquefaction of a permanent gas, for example nitrogen or methane.

A permanent gas has the property of not being able to be liquefied solely by increasing the pressure of the gas. It is necessary to cool the gas (at pressure) so as to reach a temperature at which the gas can exist in equilibrium with its liquid state.

Conventional processes for liquefying a permanent gas or for cooling it to or below the critical point typically require the gas to be compressed (unless it is already available at a suitably elevated pressure, generally a pressure above 30 atmospheres) and heat exchanged in one or more heat exchangers against at least one relatively low pressure stream of working fluid. At least some of the working fluid is provided at a temperature below the critical temperature of the permanent gas. At least part of the stream of of the stream or of each stream of working fluid is typically formed by compressing the working fluid, cooling it in the aforesaid heat exchanger or heat exchangers, and then expanding it with the performance of external work ("work expansion"). The working fluid may itself be taken from the high pressure stream of permanent gas, or the permanent gas may be kept separate from the working fluid, which may nonetheless have the same composition as the permanent gas.

Typically, the liquefied permanent gas is stored or used at a pressure substantially lower than that at which it is taken for isobaric cooling to below its critical temperature. Accordingly, after completing such isobaric cooling, the permanent gas at below its critical temperature is passed through an expansion or throttling valve whereby the pressure to which it is subjected is substantially reduced, and a substantial volume of so called "flash gas" is produced. The expansion is substantially isenthalpic and results in a reduction in the temperature of the liquid being effected. Generally, one or two such expansion is performed to produce liquefied permanent gas in equilibrium with its vapour at a storage pressure.

Generally, the thermodynamic efficiency of commercial processes for liquefying permanent gas is relatively low and there is ample scope for improving such efficiency. Considerable emphasis in the art has been placed on improving the total efficiency of the process by improving the efficiency of heat exchange in the process. Thus, prior proposals in the art have centred around minimising the temperature difference between the permanent gas stream and the working fluid stream or streams being heat exchanged therewith.

The present invention is however concerned with the improvement of a sub-critical temperature working fluid cycle used to provide refrigeration for the permanent gas stream.

DETAILED DESCRIPTION OF THE INVENTION

According to the present invention there is provided a method of liquefying a permanent gas stream, comprising the steps of reducing the temperature of the permanent gas stream at elevated pressure to below its critical temperature, and performing at least two working fluid cycles to provide at least part of the refrigeration necessary to reduce the temperature of the permanent gas to below its critical temperature, each such working fluid cycle comprising compressing the working fluid; cooling it, work expanding the cooled working fluid, warming the work expanded working fluid in countercurrent heat exchange with the permanent gas stream and with the working fluid being cooled, refrigeration thereby being provided for the per manent gas stream, wherein in at least one working fluid cycle, work expanded working fluid is brought into countercurrent heat exchange relationship with the permanent gas stream at a temperature below the critical temperature of the permanent gas and in the or each such cycle, at the completion of work expansion, the working fluid is at a pressure of at least 10 atmospheres.

Preferably, said pressure is in the range of 12 to 20 atmospheres. In working fluid cycles employing one expansion turbine to effect work expansion of the working fluid, such pressure of at least 10 atmospheres is the outlet pressure of the expansion turbine. Such outlet pressures are much higher than those conventionally employed in comparable liquefaction methods. By employing an outlet pressure of at least 10 atmospheres we are able to increase the specific heat of the working fluid brought into heat exchange relationship with the permanent gas stream, making it possible to increase the theremodynamic efficiency of the sub-critical temperature working fluid cycle and hence to decrease its specific power consumption.

Preferably, if the outlet pressure of the expansion turbine is in the range 12 to 20 atmospheres, once the work expansion is completed, the working fluid is at its saturation temperature or at a temperature up to 2 K. higher than the saturation temperature. At and close to the saturation temperature, the specific heat of the working fluid increases relatively rapidly with decreasing temperature. Accordingly our preference for having the working fluid work expanded to its saturation temperature (or one close thereto) makes it possible to enhance the benefit in terms of increased thermodynamic efficiency to be gained by employing an expansion turbine outlet pressure of at least 10 atmospheres. Indeed the working fluid, once its work expansion is complete, may advantageously be fully saturated vapour or wet.

A consequence of employing an expansion turbine outlet pressure range of at least 10 atmospheres in the sub-critical temperature working fluid cycle is that the refrigeration that can be produced by the cycle and hence the refrigeration load that can be placed upon it is limited. Accordingly, it is typically desirable to take the permanent gas stream at a relatively high temperature (e.g. in the range 107 to 117 K., and preferably about 110 K., for nitrogen) for expansion (i.e. pressure reduction) to a storage pressure (e.g. a pressure in the order of 1 atmosphere). Conventionally, expansion of the liquefied permanent gas stream to the storage pressure is performed isenthalpically by passing the permanent gas stream through one or two expansion valves. We believe that this is a relatively inefficient means of performing the expansion entailing a considerable amount of irreversible work, and if such means is employed most if not all the benefits in power consumption made possible by the invention will be lost. However, we believe it is possible to perform the expansion to a storage pressure more efficiently than is possible with one or two isenthalpic expansions. For example, the permanent gas stream at the elevated pressure and a temperature below the critical temperature of the permanent gas stream may be subjected to at least three successive isenthalpic expansions; the resultant flash gas separated from the resultant liquid after each isenthalpic expansion, liquid from each isenthalpic expansion, save the last, being the fluid that is expanded in the immediately succeeding isenthalpic expansion, and at least some (and typically all) of the said flash gas is heat exchanged with said permanent gas stream. Typically, after passing out of heat exchange relationship with the permanent gas stream, the flash gas is recompressed with incoming permanent gas for liquefaction. In addition to one or more of the flash separation stages, the fluid may be reduced in pressure by means of one or more expansion turbines.

We prefer to bring at least some and preferably all of the said flash gas into heat exchange relationship with said permanent gas stream at a permanent gas stream temperature lower than that at which work-expanded working fluid is brought into heat exchange relationship with said permanent gas stream. In one typical example, we believe we can reduce the temperature of the permanent gas stream by approximately 3 K. and this means that the temperature at which the permanent gas stream is taken for expansion can be 3 K. higher than it would otherwise need to be, thereby increasing the scope for raising the outlet pressure of the expansion turbine in the said sub-critical working fluid cycle above 12 atmospheres and hence for raising the specific heat of the working fluid entering into heat exchange relationship with the permanent gas stream.

In the example of nitrogen being the permanent gas stream, we prefer to reduce the temperature of the nitrogen to 107 to 117 K. before subjecting it to the aforesaid successive isenthalpic expansions. Thus,the flash gas is able to provide cooling for the permanent gas stream from a temperature from at or near to ambient to a temperature of from 107 to 117 K. A temperature of 110 K. may be used over a wide range of permanent gas stream pressures. Typically, in the sub-critical temperature working fluid cycle, work expanded working fluid provides cooling for the permanent gas stream from a temperature at or near ambient temperature to a temperature in the range of 110 to 118 K.

If the permanent gas is, say, a nitrogen stream produced by a cryogenic air separation plant generating at least several hundred tonnes of oxygen per day., flash gas is typically produced at a rate of about half that at which product liquid nitrogen is formed and the nitrogen stream may be taken for said iscenthalpic expansions at the said temperature of 110 K. In those smaller plants where centrifugal compressors are used and at expansion turbine outlet temperatures approaching the critical temperature of the working fluid, a relatively higher rate of formation of flash gas (e.g. up to 100% of the rate at which product liquid if formed) is typically preferred to increase the recycle gas volume and maintain the recycle compressor efficiency. If the outlet temperature of the turbine does approach the critical temperature, it will not in general be possible to maintain the outlet temperature within 2 K. of the saturation temperature unless an exceptionally high outlet pressure is also employed (i.e. over 20 atmospheres in the example of nitrogen as the working fluid).

If desired, two or more work expansion stages may be employed in a working fluid cycle. For example, in a working fluid cycle operating at above the critical temperature of the permanent gas stream, the working fluid intermediate the cooling and warming stages may be work-expanded to an intermediate pressure, partially reheated and work expanded to a lower pressure but typically the same temperature as produced by the first work expansion.

Preferably, at least one working fluid cycle is provided in which working fluid is brought into heat exchange relationship with the permanent gas stream at a temperature above the critical temperature of the gas stream. The use of such a working fluid cycle also helps to reduce the refrigeration load of the sub-critical temperature working fluid cycle. Typically in such working fluid cycle or cycles, the work expanded working fluid provides cooling for the permanent gas stream from at or near ambient temperature down to a temperature in the range 135 to 180 K. Typically, the permanent gas stream is also cooled by heat exchange with at least one stream of refrigerant. The said stream of refrigerant is brought into countercurrent heat exchange relationship with the permanent gas stream at a temperature or temperatures above those at which work expanded working fluid is brought with the permanent gas stream.

In the example of the liquefaction of nitrogen, we prefer to provide cooling of the permanent gas stream from ambient temperature down to about 210 K by means of the said stream of refrigerant. The advantage of so doing is that it reduces the refrigeration load on the higher temperature work expansion stage or stages and thus enables it or them to be operated more efficiently would otherwise be possible.

The refrigerant is typically a "Freon" or other such non-permanent gas employed in refrigeration. The working fluid is typically a permanent gas and is for convenience generally taken from the gas to be liquefied and may also be remerged therewith for compression.

In general, it is desirable to maintain a close conformity between the temperature-enthalpy. profile of the permanent gas stream and that of the working fluid, particularly in the temperature range above the critical temperature where the rate of change in the specific heat of the permanent gas is at a maximum (e.g. between about 135 and 180 K. for nitrogen at 45 atmospheres). The precise temperatures at which work expanded working fluid is brought into countercurrent heat exchange relationship with the permanent gas stream and the number of working fluid cycles that are employed may be selected so as to provide such conformity. In liquefying permanent gas supplied at a pressure of 45 atmospheres or less we prefer to employ three working fluid cycles for this purpose. By employing three cycles, we are able to keep the refrigeration load on the sub-critical temperature cycle to a level that facilitates the setting of the outlet pressure of the turbine in the sub-critical temperature working cycle at a level of at least 10 atmospheres. In the example of the liquefaction of nitrogen at 45 atmospheres, we prefer to employ a sub-critical temperature or "cold" working fluid cycle with an expansion turbine outlet pressure of about 16 atmospheres and outlet temperature of about 112 K., an intermediate working fluid cycle with two expansion turbines both having outlet temperatures of about 136 K., and a "warm" working fluid cycle with an expansion turbine outlet temperature of about 160 K.

The higher the permanent gas pressure the less sinuous is its temperature-enthalpy. profile and therefore the more readily is a close conformity. between its temperature-enthalpy profile and that of the working fluid able to be maintained. Accordingly, at permanent gas pressures of above 45 atmospheres we prefer to employ just two working fluid cycles. For example, for nitrogen at 50 atmospheres, we prefer to employ a "cold" working fluid cycle having an expansion turbine outlet pressure of 14 atmospheres and outlet temperature of about 110 to 112 K., and a "warm" working fluid cycle having an expansion turbine outlet temperature of about 150 K.

Unless it is available at a suitably elevated pressure, the permanent gas is preferably raised to an elevated pressure in a suitable compressor or bank of compressors. In one example, the pressure of the permanent gas is raised in several steps in a multistage compressor to an intermediate pressure and is then raised to a final chosen pressure by means of at least one boost compressor whose rotor is mounted on the same shaft on the rotor of an expansion turbine employed in the work expansion of the working fluid. Typically, each different pressure flash gas stream is returned to a different stage of the multistage compressor.

In order to keep down the number of separate passes through the heat exchanger means it is preferred that the working fluid cycles share a common path through the heat exchanger back to the compressor.

The invention is not limited to the liquefaction of nitrogen and methane. Other gases such as carbon monoxide and oxygen may also be liquefied thereby.

BRIEF DESCRIPTION OF THE DRAWINGS

The invention will now be described by way of example with reference to the accompanying drawings, in which;

Referring now to FIG. 1, a main nitrogen stream 30 at ambient temperature (say 300 K.) and a super critical pressure of e.g. 45 atmospheres is passed through a heat exchange means 32 having a warm end 34 and a cold end 36 and comprising a succession of heat exchangers 38, 40, 42, 44, 46 48 and 50 each operating over a progressively lower temperature range than the heat exchanger immediately upstream of it (in respect to the direction of flow of the stream 30). On leaving the heat exchanger 50 the stream 32 has a temperature of about 110 K. It is then isenthalpically expanded through throttling valve 54 to produce liquid nitrogen at a pressure of 8 atmospheres and a volume of flash gas at 8 atmospheres. The flash gas and the liquid nitrogen at 8 atmospheres are then separated or disengaged from one another in a phase separator 56. A flash gas stream 58 is taken from the separator 56 and is returned from the cold end 36 to the warm end 34 of the heat exchange means 32 in countercurrent heat exchange relationship with the stream 30.

Figure 1:
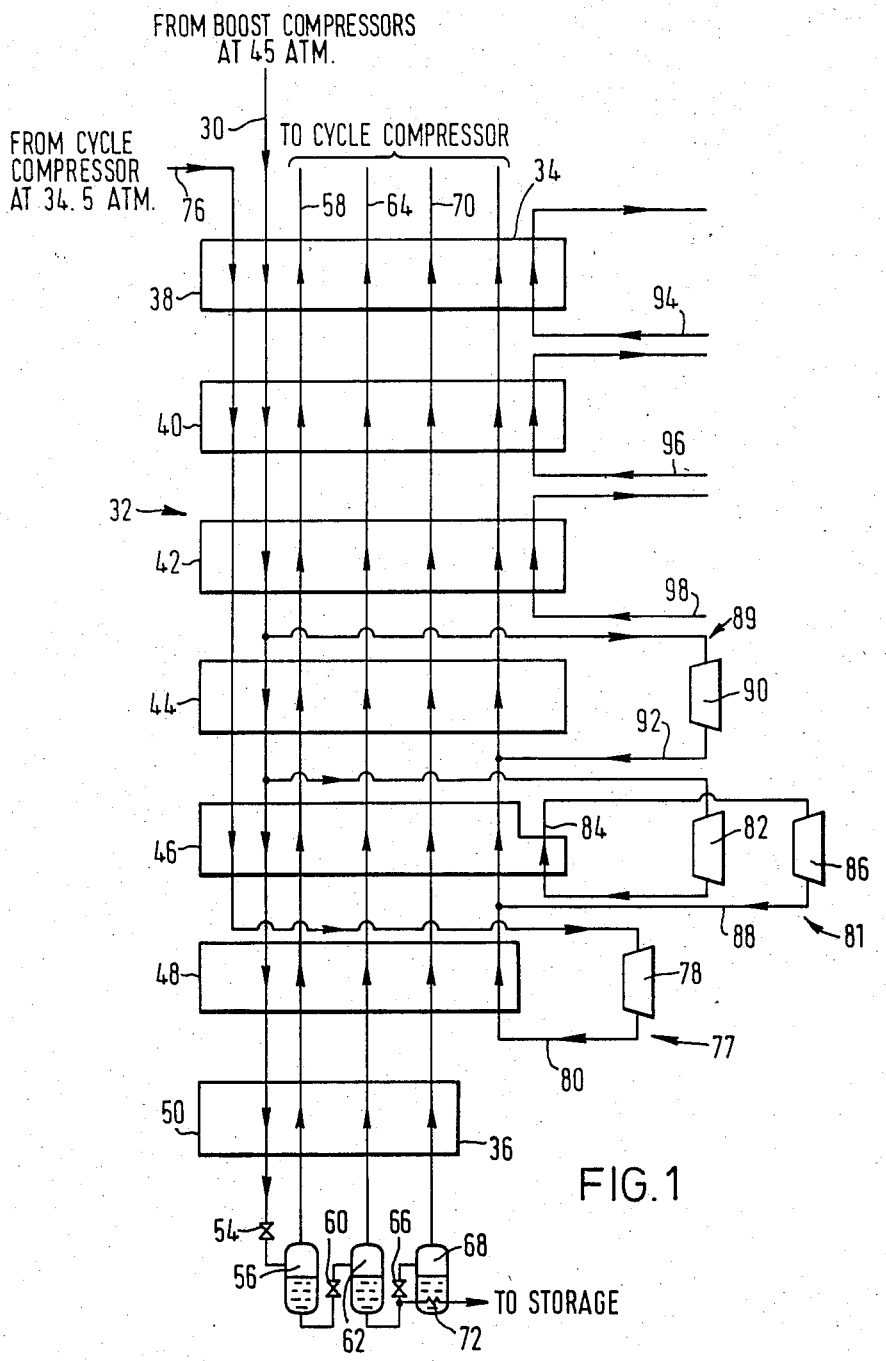
FIG. 1 is a schematic circuit diagram illustrating part of a plant for liquefying nitrogen in accordance with the invention.

The liquid nitrogen from the phase separator 56 is isenthalpically expanded through a second throttling valve 60 to produce liquid nitrogen and flash gas at a pressure of 3.1. atmospheres. The liquid nitrogen is separated from the flash gas in a second phase separator 62. A flash gas stream 64 is taken from the separator 62 and is returned from the cold end 36 to the warm end 34 of the heat exchange means 32 in countercurrent heat exchange relationship with the stream 30. Some of the liquid collecting in the phase separator 62 is isenthalpically expanded through a third throttling valve 66 to produce liquid nitrogen and flash gas at a pressure of 1.3 atmospheres. The liquid nitrogen is separated from the flash gas in a third phase separator 68 and is returned from the cold end 36 to the warm end 34 of the heat exchange means 32 in countercurrent heat exchange relationship with the stream 30. Liquid is withdrawn from the phase separator 62 and passed to storage after being undercooled in a coil 72 immersed in the liquid nitrogen in the third phase separator 68. The liquid nitrogen in the phase separator 68 is thus caused to boil and the resulting vapour joins the flash gas stream 70.

The flash gas streams 58, 64 and 70 provide all the cooling for the heat exchanger 50 and are effective to reduce the temperature of the nitrogen stream 30 from 113 to 110 K. Typically, flash gas is produced at 50% of the rate at which liquid nitrogen is passed to storage. The pressures at which flash gas is produced are determined by the pressures in the compressor stages to which the flash gas is returned from the warm end 34 of the heat exchange means 32.

The stream 76 of nitrogen working fluid in a first working fluid cycle 77 at a pressure of 34.5 atmospheres and at a temperature of about 300 K. is passed through the heat exchange means 32 cocurrently with the stream 30 and flows successively through heat exchangers 38,40, 42, 44 and 46, and leaves the heat exchanger 46 at a temperature of 138 K. This stream is then work-expanded in "cold" expansion turbine 78 to a pressure of 16 atmospheres. At such a pressure the working fluid has a relatively high specific heat, thereby making possible more efficient cooling of the permanent gas stream. The resulting working fluid leaves the turbine 78 as a stream 80 at a temperature of 112 K. and is passed through the heat exchanger 48 countercurrently to the stream 30 thus being warmed and meeting the refrigeration requirements of the heat exchanger 48 and then flows successively through the heat exchangers 46, 44, 42, 40 and 38.

In a second working fluid cycle 81, a portion of the stream 30 is withdrawn therefrom as working fluid at a location intermediate the cold end of the heat exchanger 44 and the warm end of the heat exchanger 46 at a temperature of 163 K. and is passed into a first intermediate expansion turbine 82 and is work expanded therein, leaving the turbine 82 as stream 84 at a temperaure of 136 K. and a pressure of 23 atmospheres. The stream 84 is passed through the heat exchanger 46 countercurrently to the stream 30 thus being reheated and is withdrawn from the heat exchanger at an intermediate location at a temperature of 150 K. It is then passed into a second intermediate expansion turbine 86 and is work expanded therein. The nitrogen leaves the turbine 86 as stream 88 at a pressure of 16 atmospheres and a temperature of 136 K. and is then united with the stream 80 at a region intermediate the cold end of the heat exchanger 46 and the warm end of the heat exchanger 48, and is thus able to help meet the refrigeration requirements of the heat exchanger 46, particularly as at a pressure of 16 atmospheres the working fluid has a relatively high specific heat.

In a third working fluid cycle 89, a further portion of the stream 30 is withdrawn therefrom as working fluid at a region intermediate the cold end of the heat exchanger 42 and the warm end the heat exchanger 44 and flows at a temperature of 210 K. into a "warm" expansion turbine 90 in which it is work-expanded. The nitrogen leaves the expansion turbine as stream 92 at a pressure of about 16 atmospheres and a temperature of 160.5 K. At such a pressure the working fluid has a relatively high specific heat thereby making possible more efficient cooling of the permanent gas stream. The stream 92 is then united with the stream 80 at a location intermediate the cold end of the heat exchanger 44 and the warm end of the heat exchanger 46. The stream 92 thus helps to meet the regrigeration requirements of the heat exchanger 42.

Conventional Freon refrigerators 94, 96 and 98 are employed to refrigerate the heat exchangers 38, 40 and 42 respectively. By this means the temperature of the stream 30 is able to be reduced from 3000 K. at the warm end of the heat exchange means 32 to 210 K. at the cold end of the heat exchanger 42.

Figure 3:
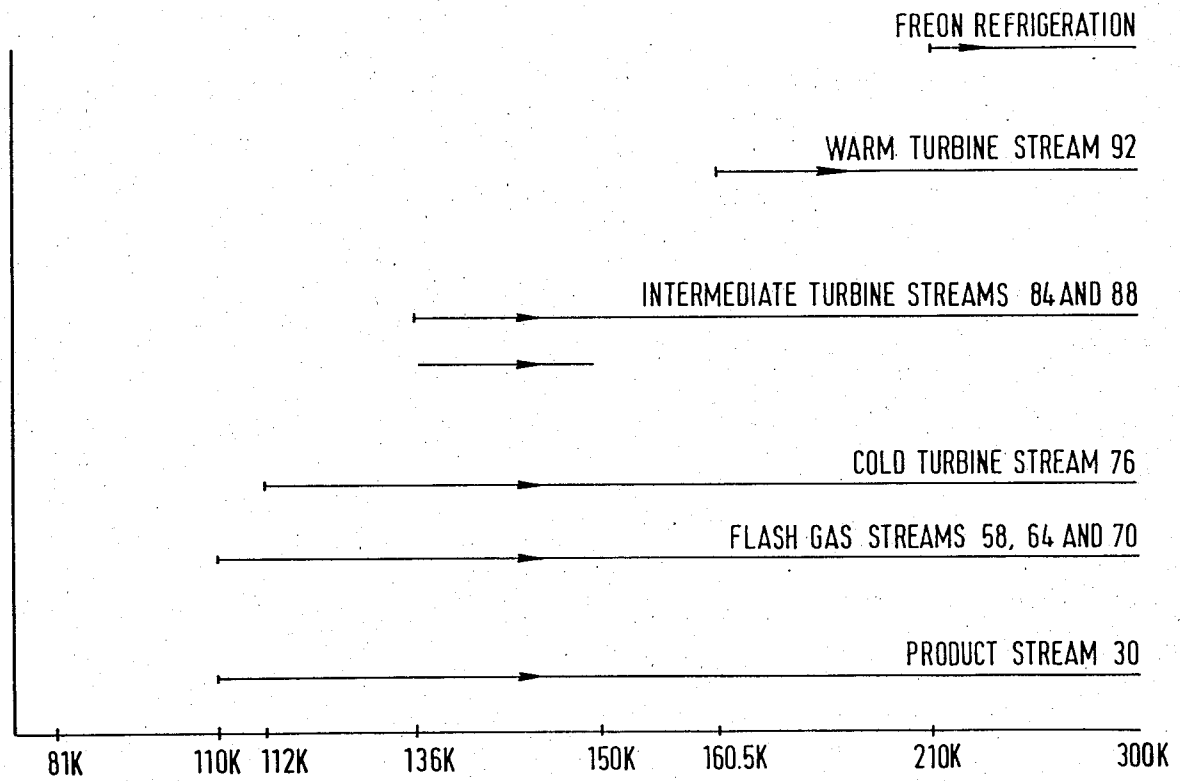
FIG. 3 is a diagrammatic representation of the plant shown in FIG. 1.

The compressor system employed in the plant shown in FIG. 1 is for purposes of enhancing the general clarity of FIG. 3 not illustrated therein. It includes, however a multi-stage compressor having a first stage which operates with an inlet pressure of 1 atmosphere and a final stage which has an outlet pressure of 34.5 atmospheres. Nitrogen at 1 atmosphere is fed to the inlet of the first stage together with the flash gas stream 70. During succeeding stages it is united with the flash gas streams 64 and 58 after they have left the warm end 34 of theheat exchange means 32. It is also united with the stream 80 of returning work expanded working fluid in a further stage of the compressor.

Each of the streams 58, 64, 70 and 80 is supplied to a different stage of the compressor from the others.

A part of the gas leaving the multistage compressor is taken to form the stream 76. The remainder is further compressed by means of four boost compressors, each driven by a respective on of the expansion turbines, to a pressure of 45 atmospheres and is then used to form the main nitrogen stream 30.

Each stage of the multistage compressor and each boost compressor typically has its own water cooler associated therewith to remove the heat of compression from the compressed gas.

Figure 4:
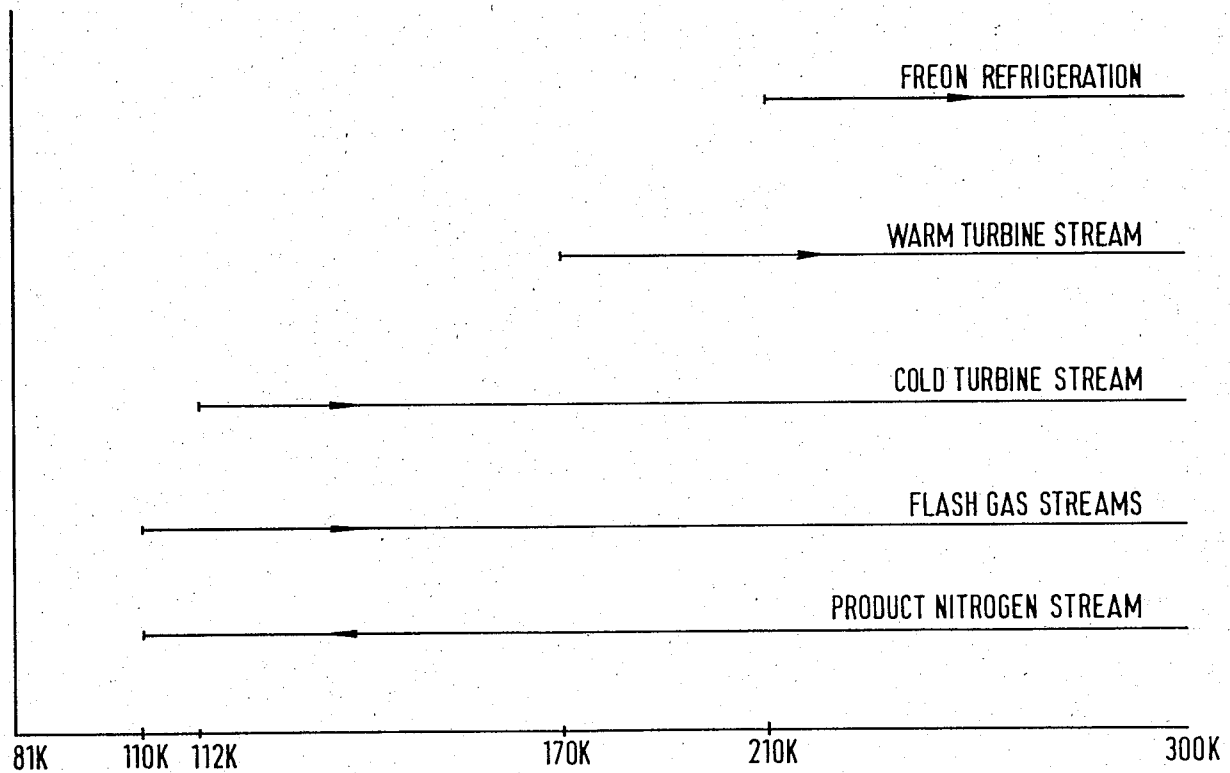
FIG. 4 is a diagrammatic representation of an alternative plant for liquefying nitrogen.

The plant shown in FIG. 1 is represented in a schematic manner in FIG. 3. An alternative plant suitable for liquefying a nitrogen stream at a pressure of more than 45 atmospheres (e.g. 50 atmospheres) is similarly represented in FIG. 4. The main difference between the plant represented in FIG. 4 and that represented in FIG. 4 is that whereas the former employs four work-expansion turbines the latter employs only two such turbines. One turbine (a "cold turbine") takes compressed nitrogen at 150 K. and reduces its temperature to about 110 K. by work expansion (to about 14 atmospheres in the example of nitrogen at 50 atmospheres), whereas the other turbine (a "warm"turbine") takes compressed nitrogen at 210 K. and reduces its temperature to about 150 K. Although, therefore, only two work expanded streams of working fluid are employed in the cooling of the product nitrogen stream to below its critical temperature, the relatively higher pressure of this stream renders its temperature enthalpy profile (not shown) less sinuous and thereby makes it possible to maintain the temperature enthalpy profiles of the return stream in reasonable conformity with the temperature enthalpy profile profile of the product nitrogen stream.

Figure 2:
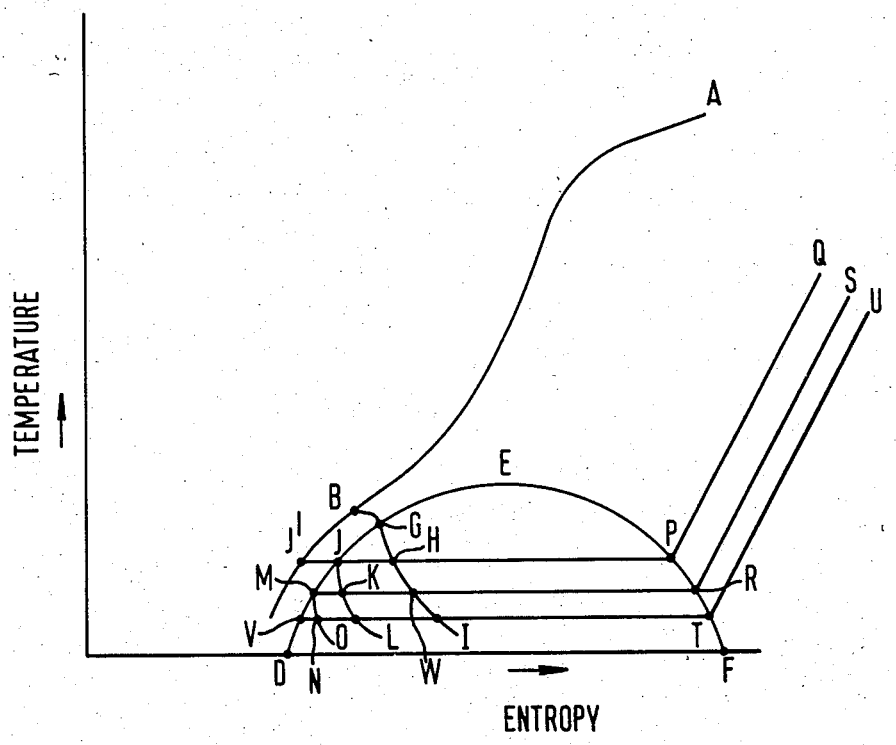
FIG. 2 is a schematic graph of temperature against entropy for nitrogen.

Referring to FIG. 2, the line AB is an isobar along which nitrogen is cooled during a process for its liquefaction. The point B represents the temperature at which the liquid nitrogen leaves the heat exchanger 36 (ie 11O K.). The curve DEF defines an "envelope" in which the nitrogen exists as a "biphase" of liquid and gas. Lines BGHI, JKL and MNO are lines of constant enthalpy. Lines PQ, RS and TU are isobars for gaseous nitrogen.

Considering now the first isenthalpic expansion through valve 54 in FIG. 1, the nitrogen follows the line of constant enthalpy BGHI until it reaches point H within the envelope DEF. The nitrogen exists there as a biphase of gas and liquid. The phase separator 56 separates the gas from the liquid; thus as a result of this separation, liquid nitrogen is obtained at point J (and flash gas at point P). The second isenthalpic expansion takes the nitrogen along the line JKL of constant enthalpy until it reaches point K. The second phase separation produces liquid at point M (and flash gas at point R). The third isenthalpic expansion takes the nitrogen along the line MNO until point N is reached. The third phase separation thus produces liquid at point V (and flash gas at point T). As shown in FIG. 1, the liquid in the third separator is evaporated by the liquid from the second separator that is undercooled. The undercooled liquid is passed to storage at a pressure equal to that at point M and at temperature between that at point M and that at point V, and close to the temperature at point V.

Suppose now that liquid at point V produced as a result of only one isenthalpic expansion. This will involve the nitrogen following the path BGHI until point W is reached. The total entropy increase involved in this step is greater than the sum of the entropy increases involved in following the paths GH, JK, and MN. This is because the lines GH, JK and MW are all relativly steep whereas the path HI is less steep; (indeed the (negative) slope of each line of constant enthalpy decreases with decreasing temperature). Accordingly, more irreversible work is involved in performing one isenthalpic expansion than in performing three successive isenthalpic expansions and hence the latter process (which is in accordance with our invention in more thermodynamically efficient than the former process.

Moreover, use of at least three isenthalpic expansions reduces the amount of working fluid on which irreversible work is performed in each isenthalpic expansion after the first. It can also be appreciated that further increases in efficiency can be gained if the point V is reached via 4 or 5 or more successive isenthalpic expansions. In practice, however, the use of more than five isenthalpic expansions gives such diminished extra benefit that it is rarely justified.

It will also be appreciated that the first isenthalpic expansion (BGH) is relatively less efficient than the second and third isenthalpic expansions, as the step BG involves a relatively large increase in entropy. Accordingly, it might be thought more advantageous to cool isobarically down to a temperature corresponding to point J' and then perform less than three isenthalpic expansions. However, such a practice would be disadvantageous as it results in an overriding loss of thermodynamic efficiency in the work expansion of working fluid necessary to reduce the temperature of the nitrogen to that at which it is taken for isenthalpic expansions, and moreover the increase in entropy J'J is greater than BG along the lines of constant enthalpy.

Figure 5:
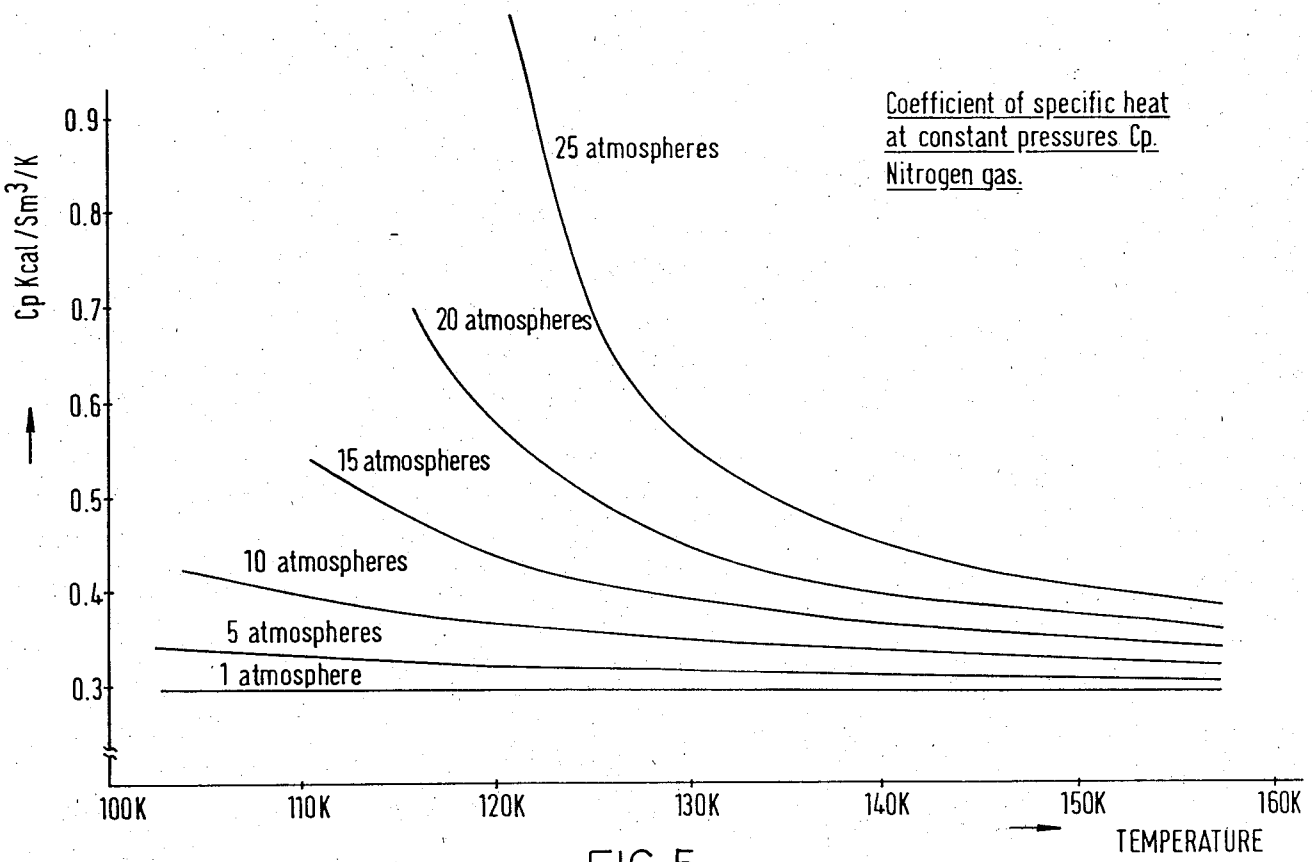
FIG. 5 is a graph showing specific heat-temperature curves for nitrogen at different pressures.

Referring again to FIG. 1 of the accompanying drawings, as the stream 80 of work-expanded working fluid (nitrogen) passes through the heat exchange means 32 towards its warm end 34 so it is progressively heated. Assuming that such passage is substantially isobaric, this means that the nitrogen will follow an isobar such as one of those illustrated in FIG. 5 of the accompanying drawings. FIG. 5 illustrates a family of curves showing the variation of the specific heat of nitrogen with temperature at various pressures ranging from 1 atmosphere to 25 atmospheres. The left hand end (as shown) of each isobar is defined by the saturation temperature of gaseous nitrogen. It can be seen that the higher the pressure of the isobar (effectively the warming curve) so that greater is the specific heat of nitrogen at any. given temperature lying on the isobar) and hence the greater is its refrigeration capacity at that temperature. The relative difference between the specific heat of nitrogen at a higher pressure and given temperature and the specific heat of nitrogen at a lower pressure and the same temperature increases with increasing higher pressure. The difference becomes particularly marked at pressure above 10 atmospheres.

We claim:

1. In a method providing refrigeration to liquify a permanent gas stream, including the steps of reducing the temperature of the permanent gas stream at elevated pressure to below its critical temperature, and performing at least two working fluid cycles to provide at least part of the refrigeration necessary to reduce the temperature of the permanent gas to below its critical temperature, each such working fluid cycle comprising compressing the working fluid, cooling it, work expanding the cooled working fluid, and warming the work expanded working fluid in countercurrent heat exchange with the permanent gas stream, refrigeration thereby being provided for the permanent gas stream, the improvement comprising, the condition that the working fluid is at a pressure of at least 10 atmospheres on completion of each working fluid cycle in which the working fluid is brought into countercurrent heat exchange relationship with the permanent gas stream at a temperature of the working fluid below the critical temperature of the permanent gas.

2. A method as claimed in claim 1, in which said pressure is in the range 12 to 20 atmospheres.

3. A method as claimed in claim 2, in which the temperature of the working fluid on completion of its work expansion is the saturation temperature at said pressure or a temperature greater than said saturation temperature by no more than 2 K.

4. A method as claimed in claim 1, in which the permanent gas stream at below its critical temperature is expanded to form a liquid product.

5. A method as claimed in claim 1, in which the permanent gas stream at below its critical temperature is subjected to at least two successive isenthalpic expansions to produce a liquid and a flash gas; the resultant flash gas is separated from the resultant liquid after each isenthalpic expansion, liquid from each isenthalpic expansion, save the last, being the fluid that is expanded in the immediately succeeding isenthalpic expansion, and at least some of the said flash gas is heat exchanged with said permanent gas stream.

6. The method of claim 5, in which there is a single working fluid cycle in which the working fluid is brought into counter-current heat exchange relationship with the nitrogen stream at a temperature of the working fluid below the critical temperature of the nitrogen.

7. A method as claimcd in claim 1, in which at least some of the said flash gas is brought into heat exchange relationship with said permanent gas stream at a permanent gas temperature lower than that at which work-expanded working fluid is brought into heat exchange relationship with said permanent gas stream.

8. A method as claimed in claim 1, in which the working fluid is from the permanent gas stream and is remerged therewith for compression.

9. The method of claim 1, in which there is a single working fluid cycle in which the working fluid is brought into countercurrent heat exchange relationship with th permanent gas stream at a temperature of the working fluid below the critical temperature of the permanent gas.

10. In a providing refrigeration to liquifying a stream of gaseous nitrogen, comprising the steps of reducing the temperature of the nitrogen stream at elevated pressure to below its critical temperature, and performing at least two working fluid cycles to provide at least part of the refrigeration necessary to reduce the temperature of the nitrogen to below its critical temperature, and then expanding the nitrogen to form a liquid nitrogen product, each such working fluid cycle comprising compressing the working fluid, cooling it, work expanding the cooled working fluid, warming the work expanded working fluid in countercurrent heat exchange with the nitrogen stream, refrigeration thereby being provided for the nitrogen stream, the improvement comprising the condition that the working fluid is at a pressure of at least 10 atmospheres on completion of each working fluid cycle in which the working fluid is brought into countercurrent heat exchange relationship with the nitrogen stream at a temperature of the working fluid below the critical temperature of the nitrogen.

11. A method as claimed in claim 10, in which said pressure is in the range 12 to 20 atmospheres.

12. A method as claimed in claim 11, in which the temperature of the working fluid on completion of its work expansion is the saturation temperature at said pressure or a temperature greater than said saturation temperature by no more than 2 K.

13. A method as claimed in claim 10, in which the nitrogen stream at below its critical temperature is subjected to at least two successive isenthalpic expansions to produce a liquid and a flash gas; the resultant flash gas is separated from the resultant liquid after each isenthalpic expansion, liquid from each isenthalpic expansion, save the last, being the fluid that is expanded in the immediately succeeding isenthalpic expansion, and at least some of the said flash gas is heat exchanged with said nitrogen stream, and at least some of the said flash gas is brought into heat exchange relationship with said nitrogen stream at a permanent gas temperature lower than that at which work-expanded working fluid is brought into heat exchange relationship with said nitrogen stream.

14. A method as claimed in claim 13, in which the first isenthalpic expansion is performed on the stream at a temperature in the range 107 to 117 K.

15. A method as claimed in claim 10, in which in at least one working fluid cycle producing work expanded working fluid at above the critical temperature of nitrogen, working fluid is brought into heat exchange relationship with the nitrogen stream at a temperature above the critical temperature of nitrogen.

16. A method as claimed in claim 15, in which in at least one working fluid cycle the work expanded working fluid provides cooling for the permanent gas stream from a temperature at or near ambient temperature to a temperature in the range 135 to 180 K.

17. A method as claimed in claim 15, in which the permanent gas stream is also cooled by heat exchange with at least one stream of refrigerant.

18. A method as claimed in claim 10, in which the working fluid is also nitrogen.

19. A method as claimed in claim 10, in which the nitrogen stream is supplied at a pressure of 45 atmospheres or less, and three working fluid cycles are employed.

20. A method as claimed in claim 10, in which the nitrogen stream is supplied at a pressure of more than 45 atmospheres and two working fluid cycles are employed.

21. A method as claimed in claim 10, in which in a working fluid cycle that brings work expanded working fluid into heat exchange relationship with the nitrogen stream at a temperature below the critical temperature of nitrogen stream, the work-expanded working fluid provides cooling for such stream from a temperature at or near ambient temperature to a temperature in the range 110 to 118 K.

22. A method as claimed in claim 21, in which only one working fluid cycle brings work expanded working fluid into heat exchange relationship with the nitrogen stream at a temperature below the critical temperature of nitrogen.

* * * * *